US007378607B2

(12) United States Patent
Koyano et al.

(10) Patent No.: US 7,378,607 B2
(45) Date of Patent: May 27, 2008

(54) KEY SHEET

(75) Inventors: Shigeru Koyano, Tokyo (JP); Yutaka Nakanishi, Tokyo (JP); Motoki Ozawa, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 96 days.

(21) Appl. No.: 11/546,432

(22) Filed: Oct. 12, 2006

(65) Prior Publication Data

US 2007/0084710 A1 Apr. 19, 2007

(30) Foreign Application Priority Data

Oct. 13, 2005 (JP) ..... 2005-299473
Aug. 31, 2006 (JP) ..... 2006-236482

(51) Int. Cl.
*H01H 3/12* (2006.01)

(52) U.S. Cl. ..... 200/341; 200/345

(58) Field of Classification Search ..... 200/310–314, 200/341–345
See application file for complete search history.

(56) References Cited

U.S. PATENT DOCUMENTS

| | | | | |
|---|---|---|---|---|
| 2003/0031860 | A1* | 2/2003 | Hotta et al. | 428/336 |
| 2006/0170332 | A1* | 8/2006 | Tamaki et al. | 313/498 |
| 2006/0170756 | A1* | 8/2006 | Ishimoto | 347/228 |
| 2006/0187641 | A1* | 8/2006 | Shin | 361/704 |

FOREIGN PATENT DOCUMENTS

| | | | |
|---|---|---|---|
| EP | 1 739 745 | A2 | 1/2007 |
| EP | 1775741 | A1 * | 4/2007 |
| EP | 1775742 | A1 * | 4/2007 |
| JP | 2000-311050 | | 11/2000 |
| JP | 2006236482 | A * | 9/2006 |
| JP | 2007134309 | A * | 5/2007 |
| JP | 2007134310 | A * | 5/2007 |
| JP | 2007173185 | A * | 7/2007 |
| WO | WO-02/082535 | A1 | 10/2002 |

OTHER PUBLICATIONS

European Search Report, Feb. 2, 2007.

* cited by examiner

*Primary Examiner*—Michael A. Friedhofer
*Assistant Examiner*—Lisa N Klaus
(74) *Attorney, Agent, or Firm*—Rader, Fishman & Grauer PLLC

(57) ABSTRACT

Disclosed is a key sheet efficiently diffusing local heat generated by a device mounted on a board. A base sheet of a key sheet is provided with a heat diffusion sheet. The heat diffusion sheet is provided with a graphite sheet and a resin film and, in some cases, a thin metal plate. The base sheet itself thus constitutes the heat diffusion sheet, so even if no member for heat diffusion is provided between a board and the key sheet, it is possible to diffuse local heat generated by a semiconductor device in the face direction of the base sheet. Thus, with the key sheet, it is possible to meet the requirement for heat diffusion to eliminate local heat storage in electronic apparatuses and to meet the requirement for a reduction in the thickness and further in weight of electronic apparatuses.

28 Claims, 10 Drawing Sheets

KEY SHEET

BACKGROUND OF THE INVENTION

1. Field of the Invention

The present invention relates to a pushbutton switch key sheet for use in various electronic apparatuses, such as a portable information terminal, including: a mobile phone; a personal digital assistant (PDA), a vehicle-mounted AV apparatus, a remote controller, and a personal computer.

2. Description of the Related Art

Many pushbutton switches for various electronic apparatuses, such as a mobile phone and an AV apparatus, are of a construction in which the pushbuttons (i.e., key tops) for performing input operation through depression are exposed through an operation opening formed in the casing of the electronic apparatus. To be specific, it is common practice to place a key sheet having key tops on a board on which contact switches are arranged and to cover the front side of the key sheet with the casing to thereby incorporate the key sheet into the casing.

Electronic apparatuses, whose functions are becoming more and more sophisticated, adopt a construction in which the heat generated within the apparatus is dissipated. This heat is generated by the mounted components, such as semiconductor devices and electronic components, mounted on the board with high density. Above all, the semiconductor devices increase in heat generation amount in accordance with an improvement in processing capacity and an increase in processing capacitance, and if local heat storage is left unattended, there is a fear of a malfunction and failure. Thus, it is necessary for the heat generated around the mounted components to be effectively dissipated to the ambient space without being allowed to locally stay.

As a conventional example of a countermeasure against this heat, a cooling component, such as a heat sink or a cooling fin, is attached to the heat-generating mounted component through the intermediation of a heat conductive sheet, a heat conductive grease, etc. However, while such a countermeasure against heat is taken for the mounting surface side of the board, no sufficient countermeasure against heat has been taken for the back surface side thereof. Thus, as the heat generation amount increases, local heat storage occurs also on the back surface side of the board.

For example, in a portable electronic apparatus, such as a mobile phone, such local heat storage is a serious problem that should be solved as soon as possible. That is, in a portable electronic apparatus, there are mounted many functions involving a large processing load, such as a moving picture reproducing function. Thus, ideally, it is desirable to take such a countermeasure against heat as mentioned above for both sides of the board. However, in view of the fact that there is a demand for a further reduction in the thickness of electronic apparatuses, it is rather difficult to secure the requisite arrangement space for a cooling component, etc. between the key sheet and the board. Further, the fact that the key sheet is a movable component that is movable through depressing operation of the key tops also constitutes a factor making it difficult to cope with the heat between the key sheet and the board.

In this connection, for example, JP 2000-311050 A proposes a countermeasure against heat using a radiation electromagnetic wave absorption shielding plate formed of metal provided between a board contained in a keyboard and key tops for input operation, and a graphite sheet attached to this shielding plate. However, as stated above, in a portable electronic apparatus, in particular, of which a further reduction in thickness is required, there is no room left between the board and the key sheet for such a large gap as would allow taking a countermeasure against heat.

SUMMARY OF THE INVENTION

The present invention has been made in view of the above problem in the prior art. It is accordingly an object of the present invention to propose a technique allowing efficient diffusion of the local heat generated by the mounted components on the board.

To solve the above-mentioned problems, the present invention provides a key sheet, including: a key top; and a base sheet formed of a heat diffusion sheet in which a graphite sheet is covered with a polymer protective layer, with the key top being arranged on the polymer protective layer.

In this key sheet, the base sheet itself, on which the key tops are arranged, is a heat diffusion sheet, so if no heat diffusion member is provided between the board and the key sheet, the local heat generated by the devices mounted on the board can be diffused in the face direction of the base sheet by the heat diffusion sheet. Further, the graphite sheet exhibits high heat conductivity, so the heat diffusion can be effected efficiently. Thus, with the key sheet of the present invention, it is possible to meet the requirement for both heat diffusion and a reduction in the thickness of electronic apparatuses, and further, the requirement for a reduction in the weight of electronic apparatuses.

A graphite sheet is fragile and is subject to breakage and chipping. In the key sheet of the present invention, however, the fragility of the graphite sheet is compensated for by the polymer protective layer, thereby suppressing breakage and chipping. Further, if the graphite sheet is used singly, handling the graphite sheet during the production process of the key sheet and the process for assembling the graphite sheet to the electronic apparatus would be rather difficult; by covering the graphite sheet with the polymer protective layer, it is possible to achieve an improvement in terms of the ease with which the graphite sheet is handled.

In the key sheet of the present invention, the heat diffusion sheet is provided with a thin metal plate. In this construction, it is possible to suppress breakage and chipping of the fragile graphite sheet by the thin metal plate having heat conductivity, thereby making it possible to compensate for the low physical strength of the graphite sheet. It is also possible to reduce the thickness of the polymer protective layer. By reducing the thickness of the polymer protective layer of low heat conductivity, providing the thin metal plate, and the like, the heat generated by the mounted devices is easily conducted through the heat diffusion sheet, thus achieving an improvement in term of heat diffusion property. The thin metal plate may be directly stacked on the graphite sheet or indirectly through the intermediation of the polymer protective layer.

The heat diffusion sheet has the graphite sheet which is stacked to the key top side than the thin metal plate. In other words, the heat diffusion sheet has the thin metal plate on the back surface side of the graphite sheet.

Since the heat diffusion sheet has the graphite sheet which is stacked to the key top side than the thin metal plate, it is possible to raise an efficient heat diffusion compared with a heat diffusion sheet which has the thin metal plate stacked to the key top side than the graphite sheet.

If the graphite sheet exists in the direction of depressing operation of the key tops, input of the contact switches through depressing operation of the key tops is possible since the graphite sheet exhibits flexibility. However, as the graphite sheet undergoes deformation each time depressing operation is performed on the key tops, there is a fear of a crack being generated in the graphite sheet to cut off the heat conduction. Thus, there is a demand for a technique in which no graphite sheet exists in the direction of depressing operation of the key tops.

As an example of such a technique, there is provided, according to the present invention, a key sheet in which the polymer protective layer is flexible enough to support the key tops so as to be capable of being displaced through depression and in which the graphite sheet has through-holes at positions corresponding to the positions on the polymer protective layer where the key tops are arranged. In this construction, no graphite sheet exists in the direction of depressing operation of the key tops, so it is possible to suppress generation of a crack. Further, it is possible to deflect the polymer protective layer through depressing operation of the key tops to effect input on the contact switches.

In another example of the key sheet of the present invention, the heat diffusion sheet has through-holes extending in the thickness direction and float-supporting portions formed of a rubber-like elastic material filling the through-holes and elastically supporting the key tops so as to allow displacement through depression. In this construction, no graphite sheet exists in the direction of depressing operation of the key tops, so it is possible to suppress generation of a crack. Further, through elastic deformation of the float-supporting portions having a rubber-like elasticity, the float-supporting portions supporting the key tops in the direction of depressing operation of the key tops can be displaced to thereby effect input on the contact switches.

In the key sheet of the present invention, the polymer protective layer may cover at least one surface of the graphite sheet. In this construction, it is possible to compensate for the fragility of the graphite sheet with the polymer protective layer. When both sides of the graphite sheet are covered, no sheet surface of the graphite sheet is exposed, so it is possible to prevent damage, such as breakage or chipping due to contact.

In the key sheet of the present invention, the polymer protective layer may cover the entire graphite sheet. In this construction, not only both sides but also the end portions of the graphite sheet are covered, so it is possible to perfectly prevent falling-off of the graphite sheet.

In the key sheet of the present invention, the polymer protective layer may be formed of a resin film. In this construction, the graphite sheet does not easily suffer breakage or rupture even if the graphite sheet is repeatedly deflected and deformed, thereby making it possible to reliably protect the graphite sheet. Further, it is possible to reduce the thickness and weight of the base sheet.

In the key sheet of the present invention, the polymer protective layer may be formed of a coating layer. This makes it possible to reliably support the graphite sheet, and to achieve a reduction in the thickness and weight of the base sheet.

In the key sheet of the present invention, the key tops may be formed of a translucent resin, and the float-supporting portions may be formed of a rubber-like elastic material. In this construction, even if the base sheet is formed as a heat diffusion sheet having a dark-colored graphite film, the light from the illumination light source mounted on the board is guided into the key tops through the float-supporting portions, thereby making it possible to realize an illumination type key sheet in which the key tops are illuminated.

In the key sheet of the present invention, the polymer protective layer may be formed as a light diffusion layer diffusing light from the illumination light source mounted on the board. In this construction, the light diffusion layer diffuses light before the light reaches the dark-colored graphite sheet, so it is possible to suppress light absorption by the graphite sheet. Further, through diffusion of light into the ambient space, it is possible to realize an illumination type key sheet in which the key tops are brightly illuminated.

In the key sheet of the present invention, the base sheet itself constitutes the heat diffusion sheet. Thus, if no heat diffusion member is provided between the board and the key sheet, it is possible to diffuse the local heat generated by the mounted devices on the board by the heat diffusion sheet, thereby making it possible to meet the requirement for both heat diffusion and a reduction in the thickness of electronic apparatuses, and further, the requirement for a reduction in the weight of electronic apparatuses. Thus, the key sheet of the present invention proves effective for a small electronic apparatus generating a large quantity of heat, in particular, for a portable electronic apparatus, thereby making it possible to prevent a malfunction, failure, etc. of the mounted devices.

The above description of this invention should not be construed restrictively. The advantages, features, and uses of this invention will become more apparent from the following description given in connection with the accompanying drawings. Further, it should be understood that all the appropriate modifications made without departing from the gist of this invention are covered by the scope of this invention.

BRIEF DESCRIPTION OF THE DRAWINGS

In the accompanying drawings.

DESCRIPTION OF THE PREFERRED EMBODIMENTS

Figure 1:
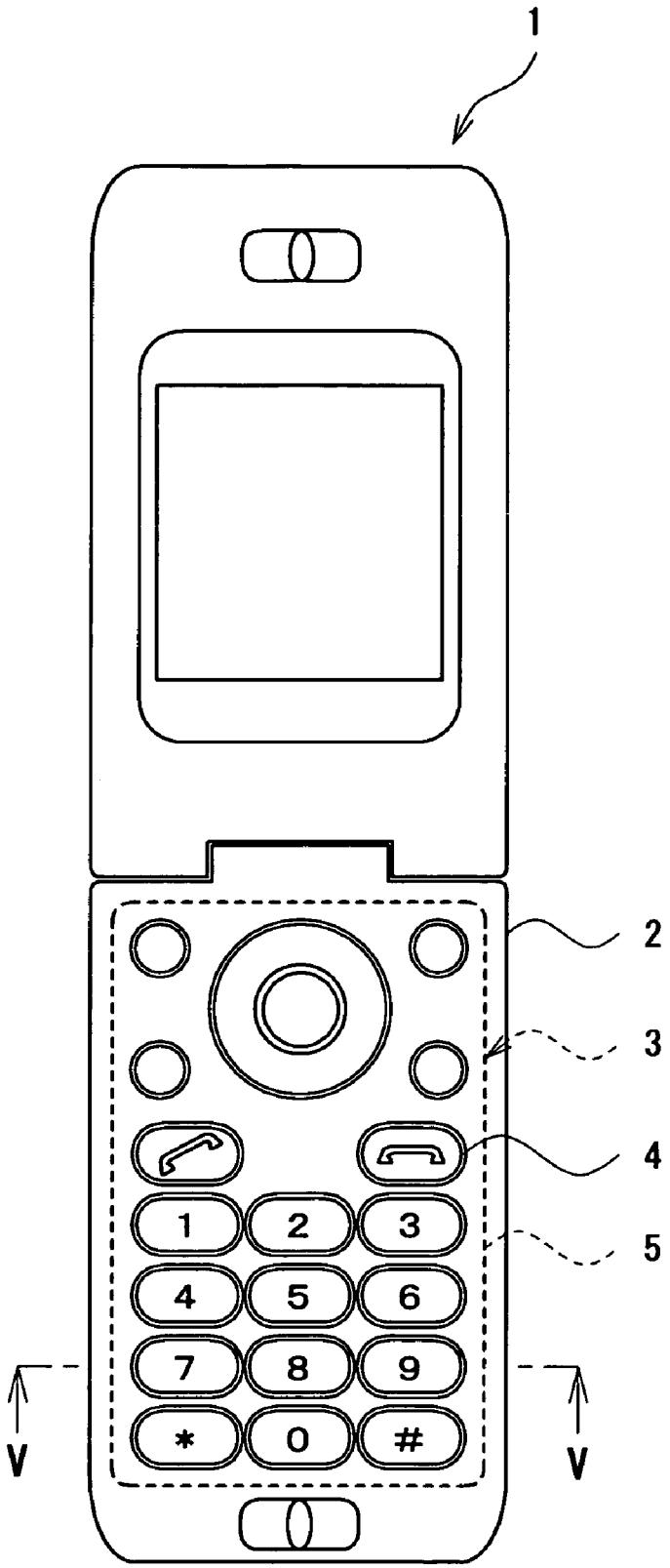
FIG. 1 is a plan view of a mobile phone.

In the following, embodiments of the present invention will be described with reference to the drawings. In the drawings, reference numerals indicate portions and components. The portions and components common among the embodiments are indicated by the same reference numerals, and a redundant descriptions of those will be omitted.

Figure 2:
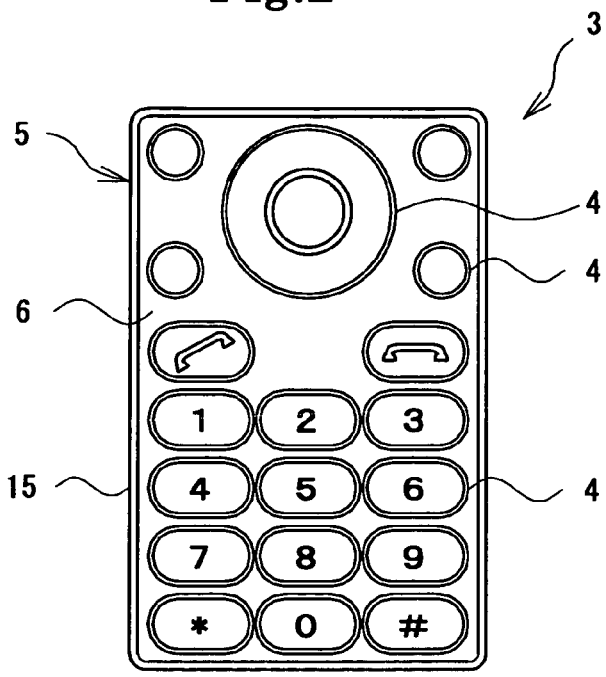
FIG. 2 is a plan view of a key sheet provided in the mobile phone of FIG. 1.

As shown in FIG. 1, a key sheet (3) according to this embodiment is mounted in a casing (2) of a mobile phone (1). The key sheet 3 is equipped with a plurality of key tops (4) and a base sheet (5). The key tops (4) of this embodiment are each formed of a hard translucent resin, and are equipped, as shown in FIGS. 1 and 2, with display printing layers for displaying figures, characters, etc. according to the key tops (4). As for the key tops (4) on which no characters, figures, etc. are displayed, they are equipped with decorating layers, such as metallic plating layers and coating layers.

Heat diffusion sheet (FIGS. 3A through 3C, FIGS. 4A through 4E): The base sheet (5) is provided with a heat diffusion sheet (6). The heat diffusion sheet (6) can be realized in various forms through combination of plan-view structures of FIGS. 3A through 3C and sectional-view structures of FIGS. 4A through 4E. Basic components of the heat diffusion sheet (6) are a graphite sheet (7) promoting diffusion of local heat generated by mounted devices, an electrically insulating polymer protective layer (8) protecting the fragile graphite sheet (7), and float-supporting portions (9) supporting the key tops (4) so as to allow displacement through depression. The reason for using the graphite sheet (7) as the base member for promoting heat diffusion is that it is markedly superior in heat conductivity as compared with other materials, and that it is lightweight and inexpensive and superior in chemical resistance, corrosion resistance, and flexibility.

(1) Plan-view structures of heat diffusion sheets according to various embodiments (FIGS. 3A through 3C): The heat diffusion sheet (6) can be realized in forms, for example, of the plan-view structures as shown in FIGS. 3A through 3C.

Figure 3A:
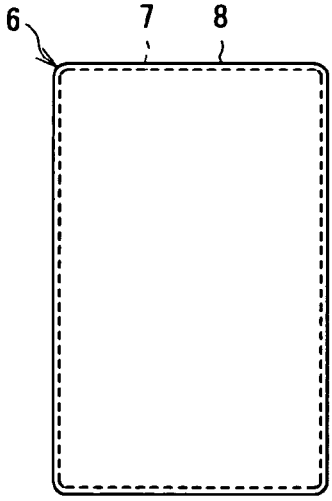
FIGS. 3A through 3C are plan views of heat diffusion sheets (i.e., base sheets) according to various embodiments.

FIG. 3A shows a form in which a single graphite sheet (7) is covered with the polymer protective layer (8). In this form, the graphite sheet (7) has no hole cutting off the heat conduction, and its entire surface can be used for heat diffusion, so it is possible to effect heat diffusion most efficiently.

Figure 3B:
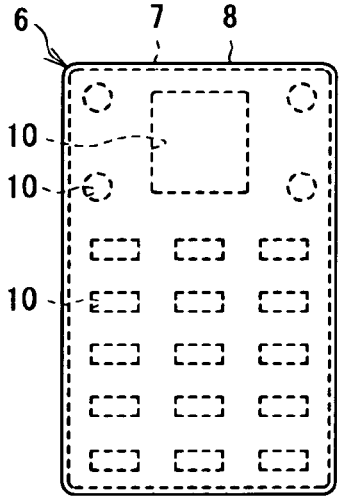

FIG. 3B shows a form in which holes (10) are provided in the graphite sheet (7) in correspondence with positions on the polymer protective layer (8) where the key tops (4) are fixed. No hole communicating with the holes (10) is formed in the polymer protective layer (8). In this form, there exists no graphite sheet (7) in a direction of depressing operation of the key tops (4). Thus, it is possible to avoid generation of a large crack in the graphite sheet (7) due to the depressing operation of the key tops (4) and cutting-off of heat conduction due to such the crack.

Figure 3C:
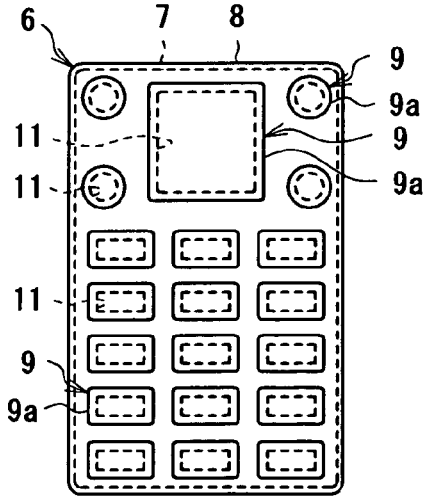

The heat diffusion sheet (6) of FIG. 3C assumes a form in which the graphite sheet (7) and the polymer protective layer (8) are provided with through-holes (11) extending in a thickness direction and in which the float-supporting portions (9), formed of a rubber-like elastic material, are provided so as to fill the holes (11). The float-supporting portions (9) have hole-edge covering portions (9*a*) covering portions around the hole edges of the holes (11) on at least one of an upper surface and a lower surface of the heat diffusion sheet (6). With this construction, a bonding area increases and a bonding strength is enhanced so that the float-supporting portions (9) are not easily detached from the heat diffusion sheet (6). If there is no problem in terms of detachment, the float-supporting portions (9) may be bonded to inner peripheral surfaces of the holes (11) without providing hole-edge covering portions (9*a*). To obtain the heat diffusion sheet (6) equipped with the float-supporting portions (9), the holes (11) are formed in the heat diffusion sheet (6) by punching, and then the heat diffusion sheet (6) is transferred to the cavity of the mold for the rubber-like elastic material. Then, the rubber-like elastic material is poured in to perform molding.

Sectional-view structures of heat diffusion sheets according to various embodiments (FIGS. 4A through 4E): The heat diffusion sheet (6), formed in one of the above-described plan-view structures, can be realized in forms of various sectional-view structures as shown, for example, in FIGS. 4A through 4E. FIGS. 4A through 4E show sectional-view structures of the portion where the graphite sheet (7) and the polymer protective layer (8) are stacked together. Thus, portions of the graphite sheet (7) corresponding to the holes (10) (FIG. 3B), portions of the heat diffusion sheet (6) corresponding to the holes (11), and portions of the heat diffusion sheet (6) corresponding to the float-supporting portions (9) (FIG. 3C) are of different sectional-view structures from those shown in FIGS. 4A through 4E.

Figure 4A:
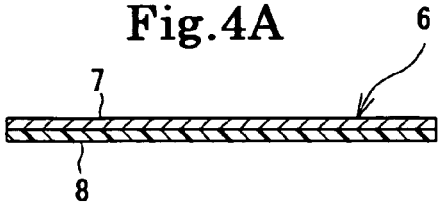
FIGS. 4A through 4E are sectional views of heat diffusion sheets (i.e., base sheets) according to various embodiments.

FIG. 4A shows a form in which a lower surface of the graphite sheet (7) is covered with the polymer protective layer (8). In this form, the electrically conductive graphite sheet (7) does not come into direct contact with a board. Thus, it is possible to place the heat diffusion sheet (6) as it is without having to covering the board surface by using a separate insulating sheet.

Figure 4B:
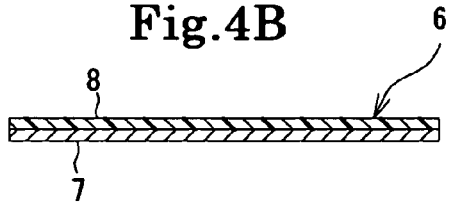

FIG. 4B shows a form in which an upper surface of the graphite sheet (7) is covered with the polymer protective layer (8). In this form, even when the key tops (4) are depressed, the key tops (4) do not come into direct contact with the graphite sheet (7), so it is possible to prevent damage of the graphite sheet (7).

Figure 4C:
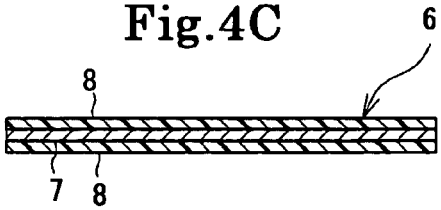

FIG. 4C shows a form in which the upper and lower surfaces of the graphite sheet (7) are respectively covered with the polymer protective layers (8). This form provides advantages of the forms shown in FIGS. 4A and 4B.

Figure 4D:
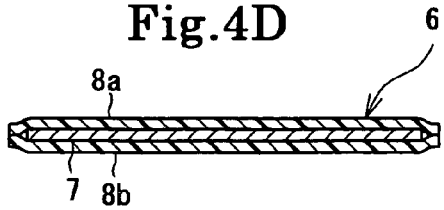

FIG. 4D shows a form in which the graphite sheet (7) as a whole is sandwiched between an upper resin film (8a) and a lower resin film (8b) as the polymer protective layers (8). In this form, the graphite sheet (7) as a whole is sealed by the polymer protective layers (8), so failing-off of an end portion of the graphite sheet (7) can be perfectly prevented.

Figure 4E:
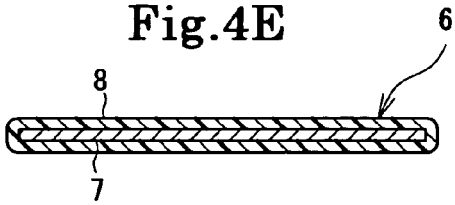
Figure 5:
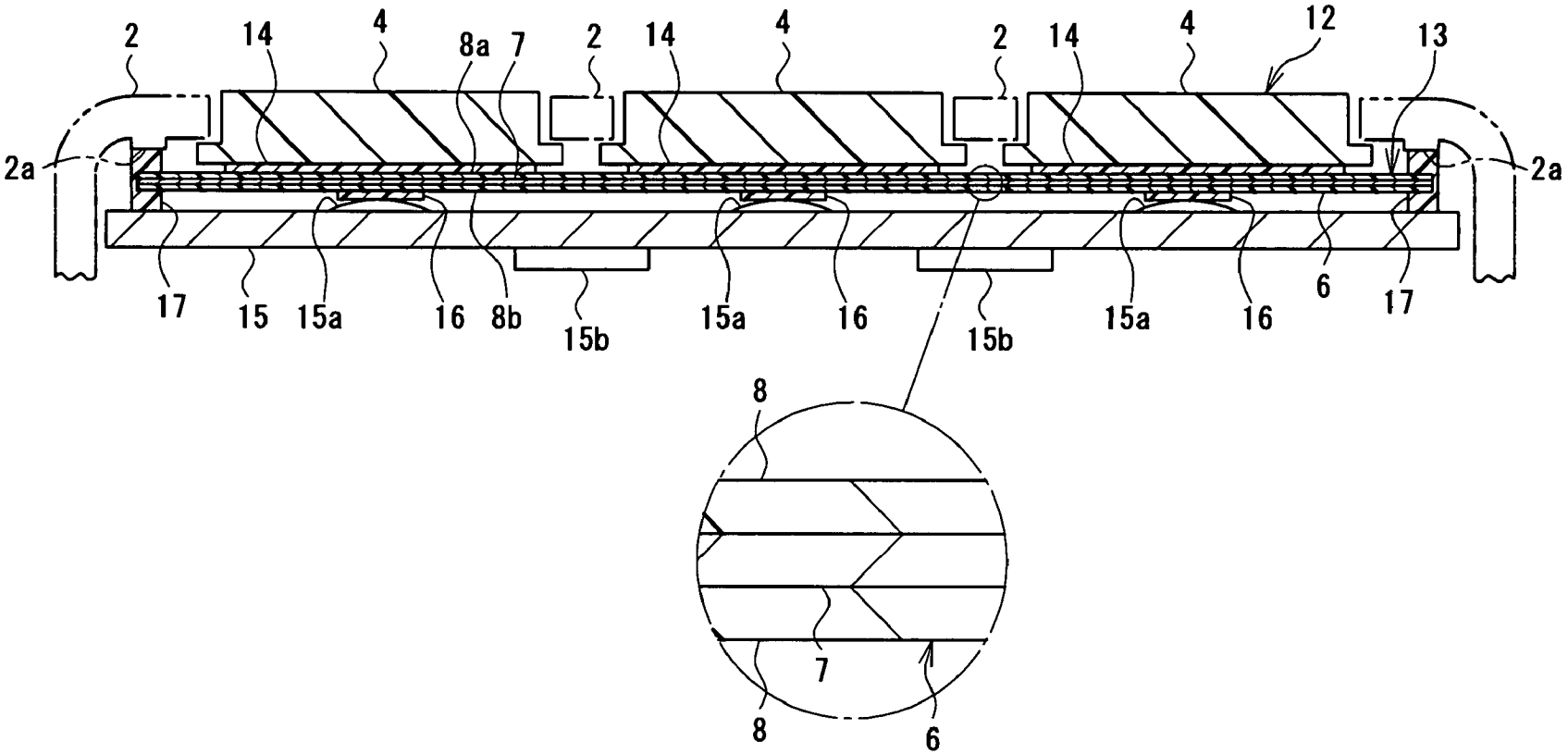
FIG. 5 is a sectional view, taken along the line V-V of FIG. 1, of a key sheet according to a first embodiment.
Figure 6:
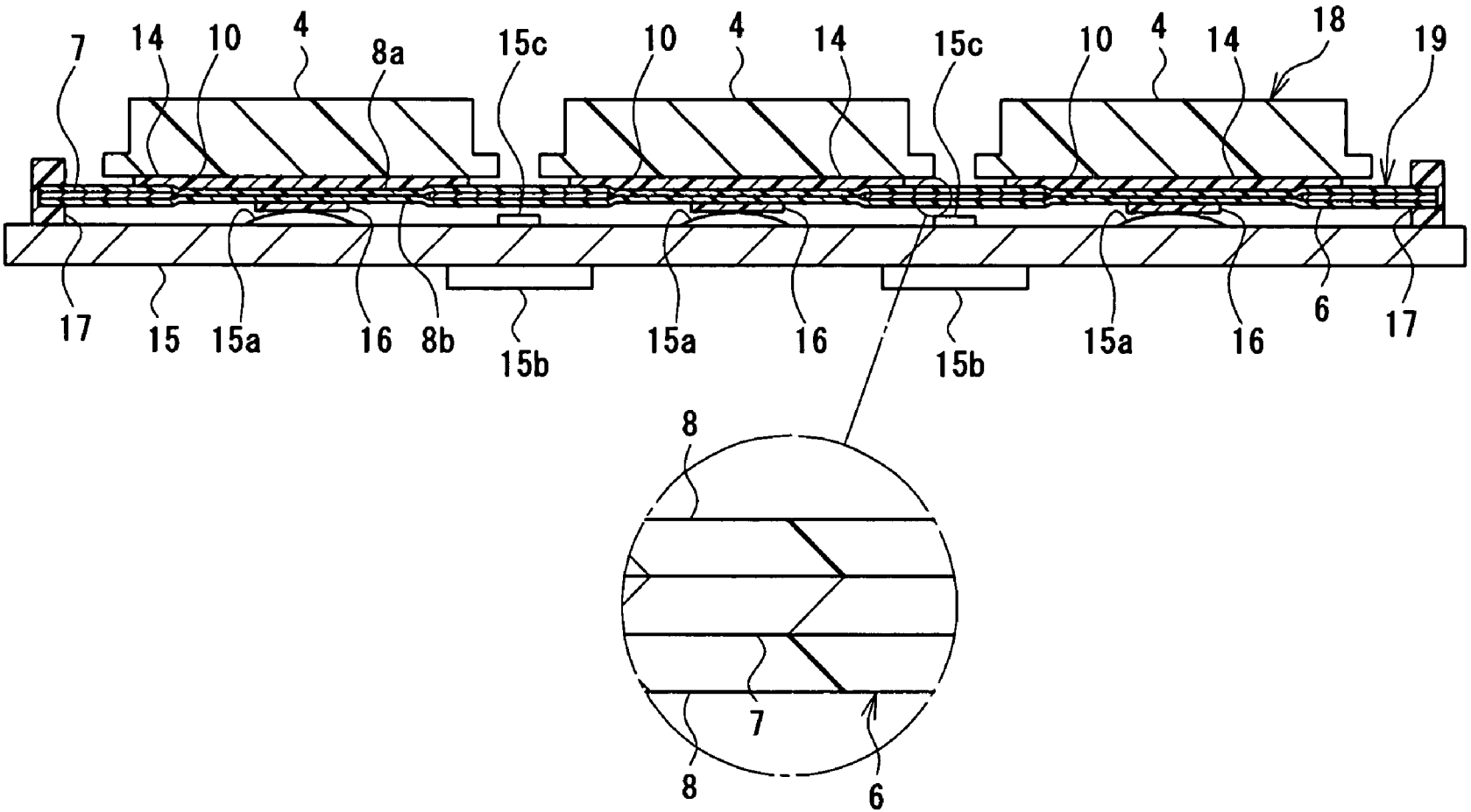
FIG. 6 is a sectional view of a key sheet according to a second embodiment.
Figure 7:
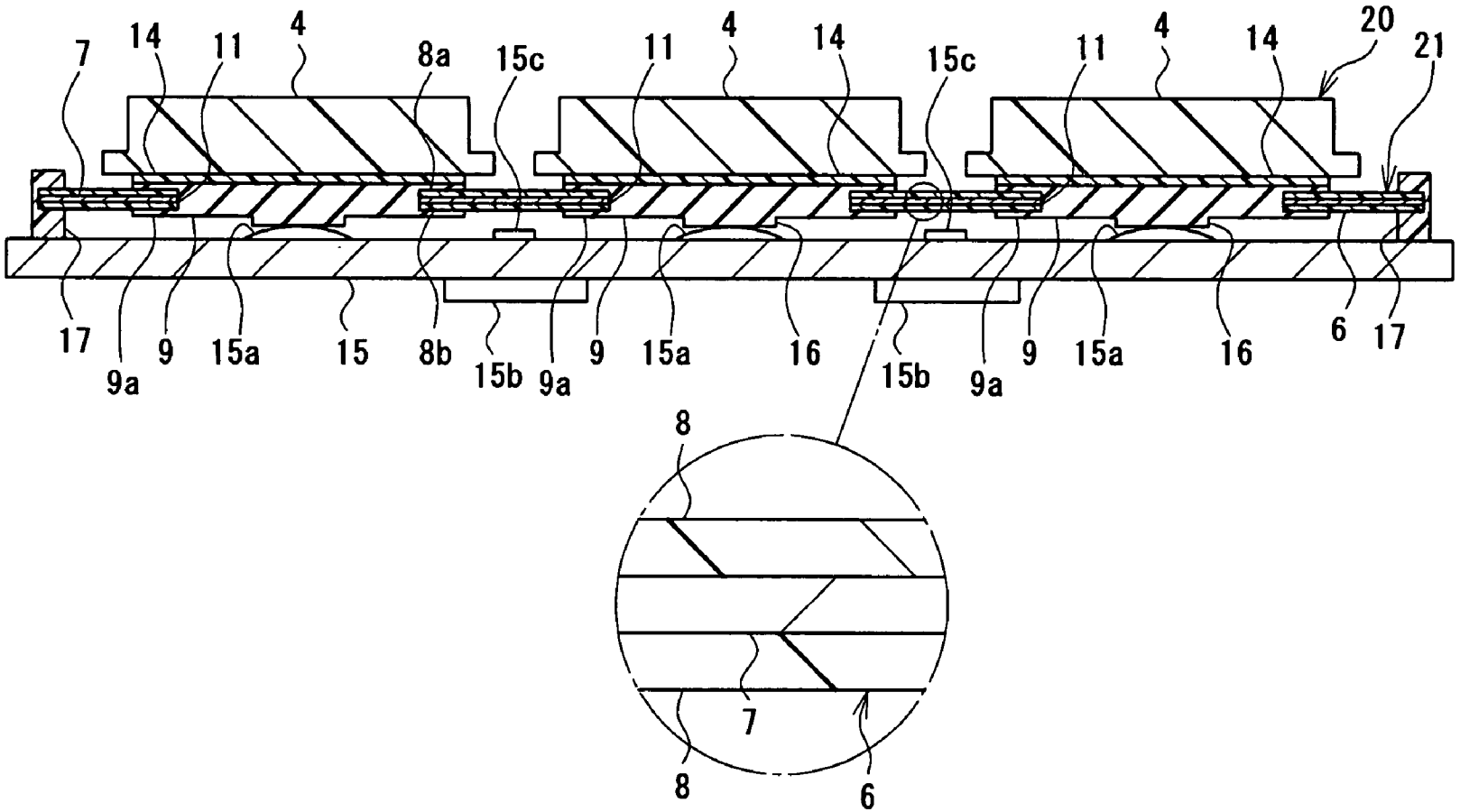
FIG. 7 is a sectional view of a key sheet according to a third embodiment.

FIG. 4E shows a form in which the graphite sheet (7) as a whole is covered with a coating layer as the polymer protective layer (8). As in the case of the form shown in FIG. 4D, in this form, falling-off of an end portion of the graphite sheet (7) can be perfectly prevented.

Of the above forms, the polymer protective layer (8) of each of the forms shown in FIGS. 4A through 4C can be formed by a resin film or a coating layer. In the case of each of the forms shown in FIGS. 4A through 4C using the polymer protective layer (8) as a resin film and in the case of the form shown in FIG. 4D using the resin films (8*a* and 8*b*), mutual bonding can be effected by applying an adhesive to the surface opposed to the graphite sheet (7) and to the opposing surfaces of the resin films (8*a* and 8*b*) and attaching them to each other.

When, as in the case of the forms shown in FIGS. 4A, 4C, and 4D, the polymer protective layer (8) is on the lower surface of the graphite sheet (7), the polymer protective layer (8) can be endowed with not only a function of protecting the graphite sheet (7) but a function of a light diffusion layer. When the key sheet (3) is formed as an illumination type key sheet in which visual recognition of the key tops (4) can be clearly effected even in a dark place due to light from an illumination light source, such as an LED chip, mounted on the board, there is a fear of an illumination luminance being reduced due to light absorption by the graphite sheet (7), which is of a dark color. In such the cases, it is possible to enhance the illumination luminance of the key tops (4) by causing the polymer protective layer (8) to function also as a light diffusion layer to thereby disperse the light to an ambient space.

(3) Form of each member of thermal diffusion sheet: When the polymer protective layer (8) is formed as a resin film or a coating layer, a resin excellent in flexibility is used as a material for forming the polymer protective layer (8). For example, when the polymer protective layer (8) is formed as a resin film, films each composed of polyethylene terephthalate, polybutylene terephthalate, polycarbonate, polyimide, polyurethane, polyethylene, polypropylene, or the like can be employed. The integration with the graphite sheet (7) can be performed by joining through an intermediation of an adhesive layer or an adhesion layer, or by means of dry laminating. When the polymer protective layer (8) is formed as a coating layer, any one of the group consisting of a urethane-based coating compound, an epoxy-based coating compound, an imide-based coating compound, an acryl-based coating compound, a fluorine-based coating compound, a silicone-based compound, and the like can be used, and the coating layer can be formed by immersing the graphite sheet (7) into, or coating or printing with the above-mentioned coating compound.

When the polymer protective layer (8) is also allowed to function as a light diffusion layer, there can be used a resin film formed by blending a material such as polyethylene terephthalate, polybutylene terephthalate, polycarbonate, polyimide, polyurethane, polyethylene, or polypropylene with a light diffusing filler such as a white pigment, glass beads, or resin beads in this case, a resin film having an improved light diffusing property, which is obtained by applying blasting or embossing onto a surface of a resin film can also be used. In addition, a transparent resin film onto which blasting or embossing is applied can be used. Further, the polymer protective layer (8) may be a coating layer formed by allowing immersion into, or coating or printing with an ink or a coating compound in which a light diffusing filler is blended. By forming the polymer protective layer (8) as such the resin film or coating layer, the entire surface of the polymer protective layer (8) can function as a light diffusion layer, while a part thereof can also function as a light diffusion layer. For example, when the graphite sheet (7) has a hole (10) as shown in FIG. 3B, only an area on a transparent resin film serving as the polymer protective layer (8), which is covered with the graphite sheet (7), may be applied with blasting or embossing. Consequently, only the area can be allowed to function as the light diffusing layer, while an area where the hole (10) is present can remain transparent, retaining a good light transmitting property.

A material for "rubber-like elastic body" is preferably a rubber or a thermoplastic elastomer each having high impact resilience. In a case of a rubber, a natural rubber, a silicone rubber, an ethylene-propylene rubber, a butadiene rubber, an isoprene rubber, a chloroprene rubber, a urethane rubber, or the like may be used. In a case of a thermoplastic elastomer, a styrene-based thermoplastic elastomer, an olefin-based thermoplastic elastomer, an ester-based thermoplastic elastomer, a urethane-based thermoplastic elastomer, an amide-based thermoplastic elastomer, a butadiene-based thermoplastic elastomer, an ethlylene-vinyl acetate-based thermoplastic elastomer, a fluoro-rubber-based thermoplastic elastomer, an isoprene-based thermoplastic elastomer, a chlorinated polyethylene-based thermoplastic elastomer, or the like may be used. Of those, a silicone rubber, a styrene-based thermoplastic elastomer, and an ester-based thermoplastic elastomer are preferable materials from viewpoints of excellent impact resilience and an excellent durability.

Embodiments of the key sheet (FIGS. 5 through 8): Next, embodiments of the key sheet (3) will be described. Regarding the heat diffusion sheet (6), there will be described examples in which some of the embodiments to be obtained through combination of the plan-view structures of FIGS. 3A through 3C and the sectional-view structures of FIGS. 4A through 4E are taken up to form the key sheet (3). Of course, it is also possible to form the key sheet (3) based on combinations other than plan-view structures and sectional-view structures taken up here.

(1) First Embodiment (FIG. 5): A base sheet (13) of a key sheet (12) according to a first embodiment of the present invention has a heat diffusion sheet (6) having the plan-view structure of FIG. 3A and the sectional-view structure of FIG. 4C. That is, the heat diffusion sheet (6) is formed by bonding the resin films (8*a* and 8*b*) to the upper and lower surfaces of the graphite sheet (7), respectively. The key tops (4) are firmly attached to the upper surface of the heat diffusion sheet (6), that is, the resin film (8*a*) by an adhesive layer (14). Pushers (16) formed of a hard resin for depressing contact belleville springs (15*a*) of a board (15) are bonded to the lower surface of the heat diffusion sheet (6), that is, to the resin film (8*b*), by adhesion. In the outer periphery of the key sheet (12), there is formed an elastic outer edge (17) formed of a rubber-like elastic material, which is held in a pressurized state by the board (15) and a retaining portion (2*a*) of the casing (2). As a result, a liquid-tight seal is formed with respect to the interior of the casing (2). While the outer edge of the heat diffusion sheet (6) is not sealed by the resin films (8*a* and 8*b*), the outer edge is sealed by the elastic outer edge (17).

The key sheet (12) is placed on the board (15). On the upper surface of the board (15), there are formed contact switches by the above-mentioned contact belleville springs (15*a*) and a contact circuit (not shown). Semiconductor devices (15*b*) generating heat are mounted on the lower surface of the board (15).

Next, the effects of the key sheet (12) of this embodiment will be described. Inside the casing (2), heat generated by the semiconductor devices (15*b*) stays locally around the semiconductor devices (15*b*). The heat is gradually conducted to the periphery, and a portion of the heat is conducted to the key sheet (12) through the thickness of the board (15). The heat conducted to the key sheet (12) is diffused in the face direction of the heat diffusion sheet (6) (base sheet (13)) through the graphite sheet (7), which is superior in heat conductivity. As a result, the local heat storage generated inside the casing (2) is efficiently eliminated. If no separate member for heat diffusion is mounted between the key sheet (12) and the board (15), this heat diffusion can be effected by the key sheet (12) itself (or the graphite sheet (7)). Thus, with the key sheet (12), it is possible to meet the requirement for both heat diffusion and a reduction in the thickness of the casing (2) of the mobile phone (1), and further, the requirement for a reduction in the weight of the mobile phone.

The elastic outer edge (17) covers the end surfaces of the base sheet (13). Thus, it is possible to prevent detachment of an end portion of the graphite sheet (7) from between the resin films (8*a* and 8*b*). The elastic outer edge (7) forms a watertight seal with respect to the interior of the casing (2). Thus, it is possible to prevent rainwater and dust from entering the interior of the casing (2)

(2) Second Embodiment (FIG. 6): A base sheet (19) of a key sheet (18) according to a second embodiment of the present invention has a heat diffusion sheet (6) having the plan-view structure of FIG. 3B and the sectional-view structure of FIG. 4C. That is, the heat diffusion sheet (6) is formed by bonding the resin films (8*a* and 8*b*) to the upper and lower surfaces of the graphite sheet (7), respectively, having the through-holes (10). At the portions of the through-holes (10), the resin films (8*a* and 8*b*) are bonded to each other.

The key sheet (18) of this embodiment is an illumination type key sheet in which the key tops (4) are illuminated by light from back lights (15*c*), such as LED chips, mounted on the board (15). Thus, the key tops (4), the adhesive layer (14), the resin film (8*a* and 8*b*), and the pushers (16) are all formed of a translucent resin. Of those, the resin film (8*b*) opposed to the back lights (15*c*) is formed of a material functioning as a light diffusion layer.

Like the key sheet (12) of the first embodiment, the key sheet (18) of this embodiment can realize heat diffusion and a reduction in the thickness and weight of the casing (2) of the mobile phone (1). Further, the key sheet (18) of this embodiment provides the following effects. The light emitted from the back lights (15*c*) is diffused into the ambient space by the resin film (8*b*) functioning as a light diffusion layer. That is, the light is diffused by the resin film (8*b*) before it reaches the dark-colored graphite sheet (7), and the light absorption by the graphite sheet (7) is suppressed. The diffused light substantially passes solely through the portions of the resin films (8*a* and 8*b*) corresponding to the holes (10) of the graphite sheet (7), and reaches to the upper surface side of the base sheet (19). Then, the light illuminates the key tops (4) brightly from the bottom side through the adhesive layer (14). In this way, in the key sheet (18) of this embodiment, it is possible to suppress light absorption by the graphite sheet (7), and the holes (10) of the graphite sheet (7) constitute the light guide paths. Thus, it is possible to illuminate the key tops (4) with high luminance.

(3) Third Embodiment (FIG. 7): A base sheet (21) of a key sheet (20) according to the third embodiment has a heat diffusion sheet (6) having the plan-view structure of FIG. 3C and the sectional-view structure of FIG. 4C. That is, in the heat diffusion sheet (6), the same resin films (8*a* and 8*b*) as those of the second embodiment are bonded to the upper and lower surfaces of the graphite sheet (7), and there are provided, in the through-holes (11) extending in the thickness direction, float-supporting portions (9) formed of a translucent rubber-like elastic material.

Like the key sheet (12) of the first embodiment, the key sheet (20) of this embodiment can realize heat diffusion and a reduction in the thickness and weight of the casing (2) of the mobile phone (1). Further, like the key sheet (18) of the second embodiment, the key sheet (20) can illuminate the key tops (4) with high luminance. Further, in the key sheet (20) of this embodiment, when depressing operation is performed on the key tops (4), the float-supporting portions (9) having a rubber-like elasticity are displaced in a direction of depressing operation to depress contact belleville springs (15*a*). Then, the contact belleville springs (15*a*) are reversed and come into contact with a contact circuit of the board (15), thus making it possible to perform contact input.

Figure 8A:
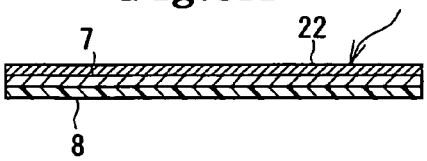
FIGS. 8A through 8N are plan views of other heat diffusion sheets (i.e., base sheets) according to various embodiments.
Figure 8N:
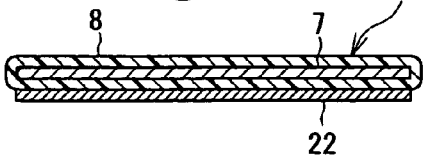
Figure 9:
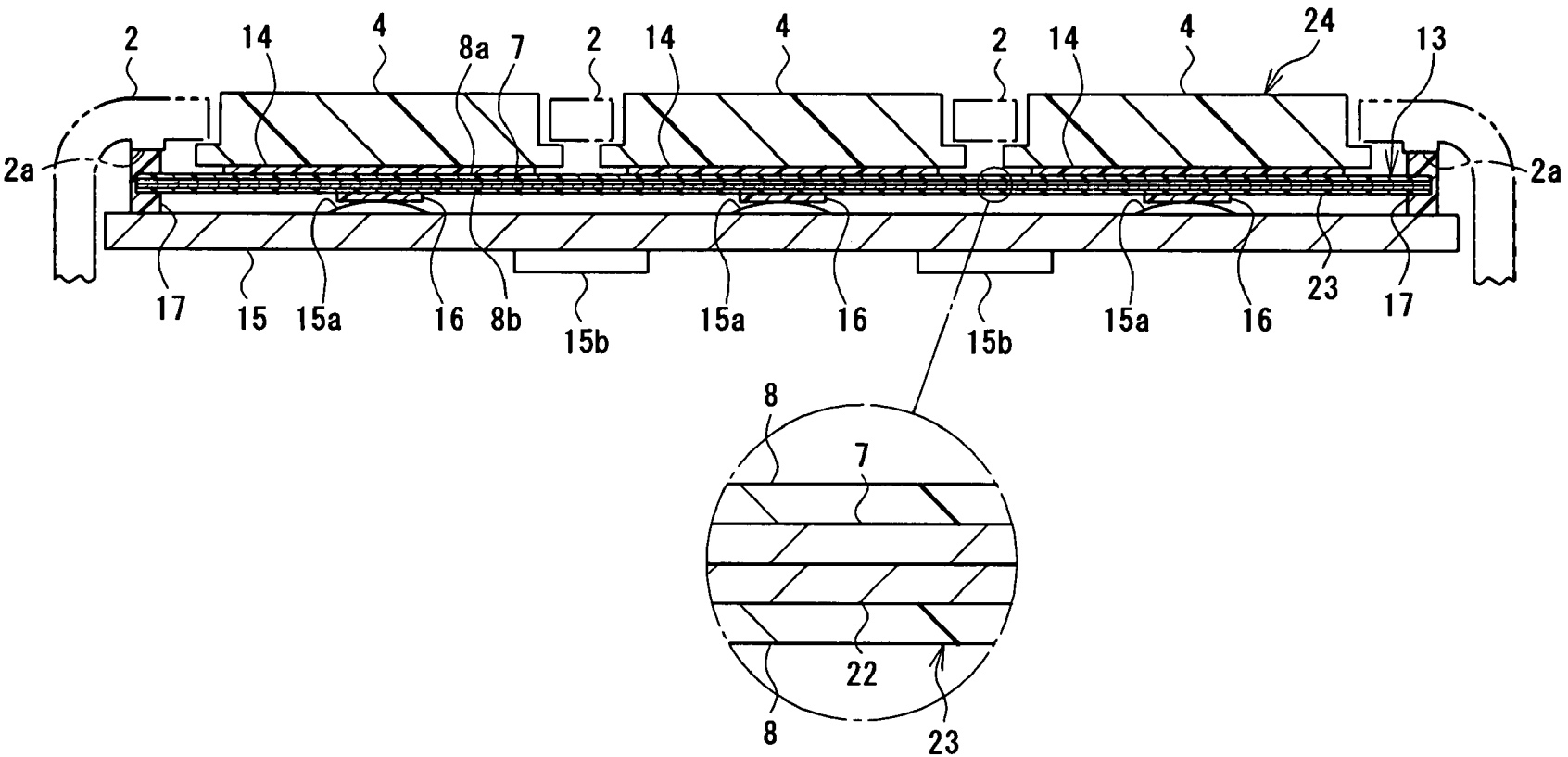
FIG. 9 is a sectional view, corresponding to FIG. 5, of a modification of the key sheet of the first embodiment.
Figure 10:
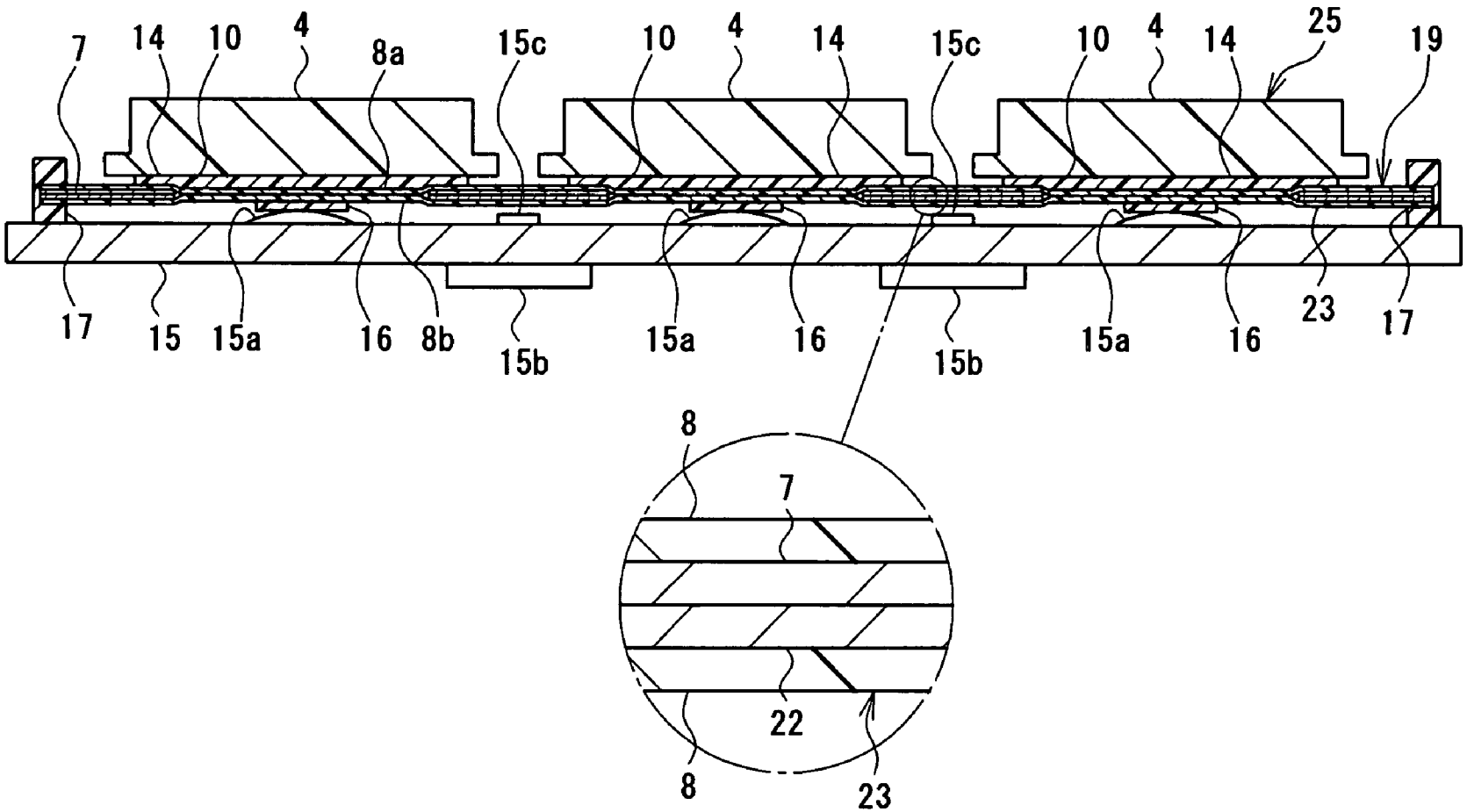
FIG. 10 is a sectional view, corresponding to FIG. 6, of a modification of the key sheet of the second embodiment.
Figure 11:
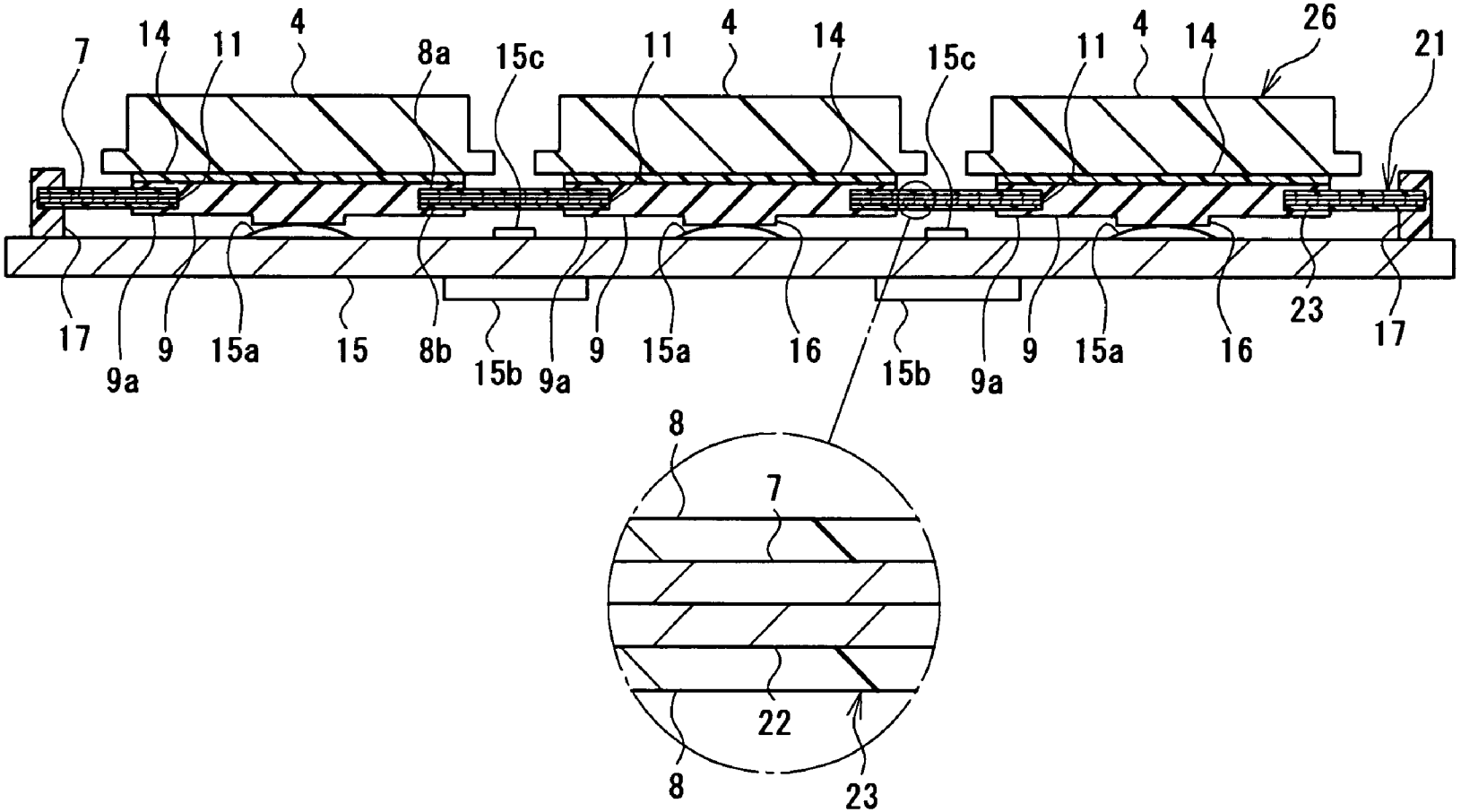
FIG. 11 is a sectional view, corresponding to FIG. 7, of a modification of the key sheet of the third embodiment.

(4) Modifications of the Embodiments (FIGS. 8A through 8N): While in the key sheets (12, 18, 20) of the first through third embodiments the base sheets (13, 19, 21) are each equipped with the heat diffusion sheet (6), it is also possible to form, as modifications of those embodiments, key sheets (24, 25, 26) as shown in FIGS. 9 through 11 using a heat diffusion sheet (23) which is further equipped with a thin metal plate (22) in addition to the graphite sheet (7). The heat diffusion sheet (23) can be realized in forms of various sectional-view structures as shown, for example, in FIGS. 8A through 8N. FIGS. 8A through 8N show sectional-view structures of the portion where the graphite sheet (7), the polymer protective layer (8), and the thin metal plate (22) are stacked together. Examples of the material of the thin metal plate (22) include single metals, such as iron, aluminum, copper, gold, silver, tin, nickel, chromium, and titanium, and an alloy of these metals.

The various forms of the heat diffusion sheet (23) shown in FIGS. 8A through 8N will be described in detail. FIG. 8A shows a form in which the lower surface of the graphite sheet (7) is covered with the polymer protective layer (8) and in which the upper surface of the graphite sheet (7) is covered with the thin metal plate (22). In this form, the electrically conductive graphite sheet (7) does not come into direct contact with the board. Thus, the heat diffusion sheet (23) can be placed as it is without having to cover the board surface with a separate insulating sheet.

Figure 8B:
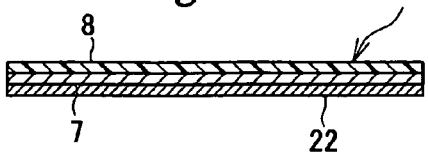

FIG. 8B shows a form in which the upper surface of the graphite sheet (7) is covered with the polymer protective layer (8) and in which the lower surface of the graphite sheet (7) is covered with the thin metal plate (22). In this form, if the key tops (4) are depressed, they do not come into direct contact with the graphite sheet (7), so it is possible to prevent the graphite sheet (7) from being damaged. Further, when the thin metal plate (22) is stacked on the lower surface of the graphite sheet (7), it is possible to enhance the heat diffusion in a face direction of the heat diffusion sheet (23).

Figure 8C:
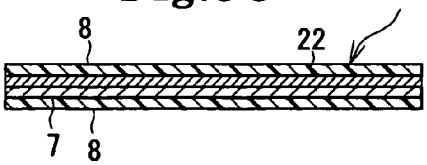

FIG. 8C shows a form in which the upper and lower surfaces of a laminate composed of the graphite sheet (7) and the thin metal plate (22) are respectively covered with the polymer protective layers (8). In this form, in addition to the advantage of the form shown in FIG. 8A, the key tops (4) do not come into direct contact with the thin metal plate (22) if depressed, so it is possible to prevent the thin metal plate (22) from being damaged.

Figure 8D:
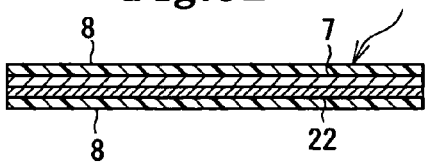

FIG. 8D shows a form in which the thin metal plate (22) is stacked on the lower surface of the graphite sheet (7) and in which the upper and lower surfaces of the resultant laminate are respectively covered with the polymer protective layers (8). In this form, in addition to the advantage of the form shown in FIG. 8B, the electrically conductive thin metal plate (22) does not come into direct contact with the board. Thus, the heat diffusion sheet (23) can be placed as it is without having to cover the board surface with a separate insulating sheet.

Figure 8E:
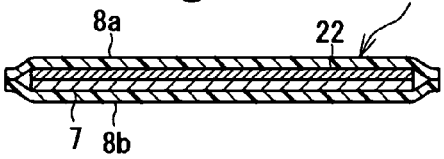

In the form shown in FIG. 8E, the thin metal plate (22) is stacked on the upper surface of the graphite sheet (7), and the whole is covered so as to be sandwiched between two upper and lower resin films (8*a* and 8*b*) as the polymer protective layers (8). In other words, both surfaces of the laminate composed of the graphite sheet (7) and the thin metal plate (22) are covered with the polymer protective layers (8). In this form, in addition to the advantage of the form shown in FIG. 8C, the entire graphite sheet (7) is sealed by the polymer protective layers (8), so it is possible to perfectly prevent falling-off of an end portion of the graphite sheet (7).

Figure 8F:
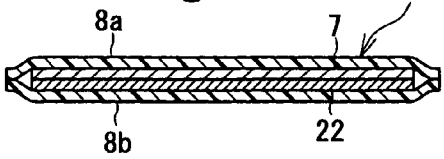

In the form shown in FIG. 8F, the thin metal plate (22) is stacked on the lower surface of the graphite sheet (7), and the whole is covered so as to be sandwiched between two upper and lower resin films (8*a* and 8*b*) as the polymer protective layers (8). In other words, both surfaces of the laminate composed of the graphite sheet (7) and the thin metal plate (22) are covered with the polymer protective layers (8). In this form, in addition to the advantage of the form shown in FIG. 8D, the entire graphite sheet (7) is sealed by the polymer protective layers (8), so it is possible to perfectly prevent falling-off of an end portion of the graphite sheet (7).

Figure 8G:
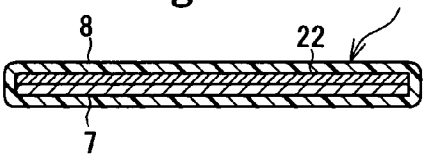

In the form shown in FIG. 8G, the thin metal plate (22) is stacked on the upper surface of the graphite sheet (7), and the whole is covered with a coating layer as the polymer protective layer (8). As in the form of FIG. 8E, in this form, it is possible to perfectly prevent falling-off of an end portion of the graphite sheet (7).

Figure 8H:
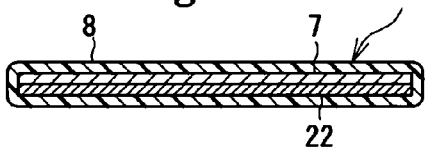
Figure 8I:
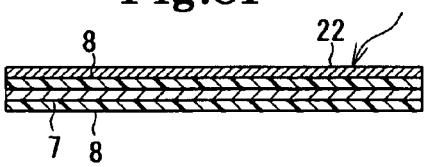

In the form shown in FIG. 8H, the thin metal plate (22) is stacked on the lower surface of the graphite sheet (7), and the whole is covered with a coating layer as the polymer protective layer (8). As in the form of FIG. 8F, in this form, it is possible to perfectly prevent falling-off of an end portion of the graphite sheet (7).

In the form shown in FIG. 81, the thin metal plate (22) is stacked on the upper surface of the heat diffusion sheet (6) in which the upper and lower surfaces of the graphite sheet (7) are covered with the polymer protective layers (8). In this form, the thin metal plate (22) is exposed on the upper surface, so it is possible to achieve an enhancement in heat diffusion as compared with the above-described form shown in FIG. 4C.

Figure 8J:
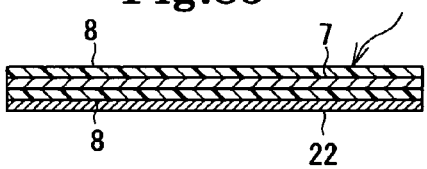

In the form shown in FIG. 8J, the thin metal plate (22) is stacked on the lower surface of the heat diffusion sheet (6) in which the upper and lower surfaces of the graphite sheet (7) are covered with the polymer protective layers (8). In this form, the thin metal plate (22) is exposed on the lower surface, so it is possible to achieve an enhancement in heat diffusion as compared with the above-described form shown in FIG. 4C. In particular, it is possible to achieve an enhancement in heat diffusion in the face direction of the heat diffusion sheet (23).

Figure 8K:
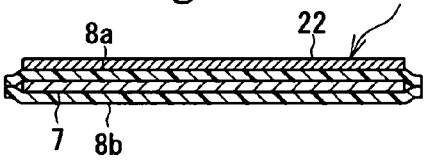

In the form shown in FIG. 8K, the thin metal plate (22) is stacked on the upper surface of the heat diffusion sheet (6) in which the entire graphite sheet (7) is covered so as to be sandwiched between two upper and lower resin films (8*a* and 8*b*) as the polymer protective layers (8). In other words, there is obtained a laminate composed of the thin metal plate (22) and the graphite sheet (7) both surfaces of which are covered with the polymer protective layers (8). In this form, the thin metal plate (22) is exposed on the upper surface, so it is possible to achieve an enhancement in heat conductivity as compared with the above-described form shown in FIG. 4D.

Figure 8L:
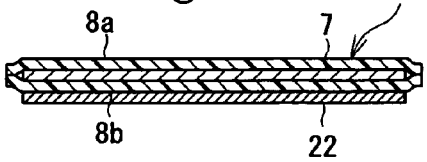

In the form shown in FIG. 8L, the thin metal plate (22) is stacked on the lower surface of the heat diffusion sheet (6) in which the entire graphite sheet (7) is covered so as to be sandwiched between two upper and lower resin films (8*a* and 8*b*) as the polymer protective layers (8). In other words, there is obtained a laminate composed of the thin metal plate (22) and the graphite sheet (7) both surfaces of which are covered with the polymer protective layers (8). In this form, the thin metal plate (22) is exposed on the lower surface, so it is possible to achieve an enhancement in heat conductivity as compared with the above-described form shown in FIG. 4D. In particular, it is possible to achieve an enhancement in heat diffusion in the face direction of the heat diffusion sheet (23).

Figure 8M:
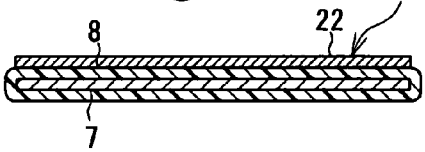

In the form shown in FIG. 8M, the thin metal plate (22) is stacked on the upper surface of the heat diffusion sheet (6) in which the entire graphite sheet (7) is covered with a coating layer as the polymer protective layer (8). In this form, the thin metal plate (22) is exposed on the upper surface, so it is possible to achieve an enhancement in heat conductivity as compared with the above-described form shown in FIG. 4E.

In the form shown in FIG. 8N, the thin metal plate (22) is stacked on the lower surface of the heat diffusion sheet (6) in which the entire graphite sheet (7) is covered with a coating layer as the polymer protective layer (8). In this form, the thin metal plate (22) is exposed on the lower surface, so it is possible to achieve an enhancement in heat conductivity as compared with the above-described form shown in FIG. 4E. In particular, it is possible to achieve an enhancement in heat diffusion in the face direction of the heat diffusion sheet (23).

As described above, by stacking the thin metal plate (22) on the graphite sheet (7), it is possible to protect the fragile graphite sheet (7) by the thin metal plate (22) having heat conductivity. In addition, it is possible to realize an efficient heat diffusion. When we compare the thin metal plate (22) stacked to a back surface or to a upper surface, thermal diffusion efficiency can be raised when the thin metal plate (22) is stacked to the back surface.

What is claimed is:

1. A key sheet, comprising:

a key top; and a base sheet formed of a heat diffusion sheet in which a graphite sheet is covered with a polymer protective layer, with the key top being arranged on the polymer protective layer.

2. A key sheet according to claim 1, wherein:

the polymer protective layer is flexible enough to support the key top so that the the key top is capable of being displaced through depression; and the graphite sheet has a through-hole at a position corresponding to the portion of the polymer protective layer where the key top is arranged.

3. A key sheet according to claim 1, wherein the polymer protective layer covers at least one surface of the graphite sheet.

4. A key sheet according to claim 3, wherein the polymer protective layer envelops and covers the graphite sheet as a whole.

5. A key sheet according to claim 1, wherein the polymer protective layer is a resin film.

6. A key sheet according to claim 1, wherein the polymer protective layer is a polymer coating film.

7. A key sheet according to claim 1, wherein the heat diffusion sheet has a through-hole extending in the thickness direction of the heat diffusion sheet and a float-supporting portion formed of a rubber-like elastic material filling the through-hole and elastically supporting the key top so that the key top is capable of being displaced through depression.

8. A key sheet according to claim 7, wherein the polymer protective layer covers at least one surface of the graphite sheet.

9. A key sheet according to claim 8, wherein the polymer protective layer envelops and covers the graphite sheet as a whole.

10. A key sheet according to claim 7, wherein the polymer protective layer is a resin film.

11. A key sheet according to claim 7, wherein the key top is formed of a translucent resin, and the float-supporting portion is formed of a translucent rubber-like elastic material.

12. A key sheet according to claim 7, wherein the polymer protective layer is a polymer coating film.

13. A key sheet according to claim 12, wherein:

the key top is formed of a translucent resin; and the float-supporting portion is formed of a translucent rubber-like elastic material.

14. A key sheet according to claim 1, wherein the heat diffusion sheet is equipped with a thin metal plate.

15. A key sheet according to claim 14, wherein:

the polymer protective layer is flexible enough to support the key top so that the key top is capable of being displaced through depression; and the graphite sheet has the through-hole at a position corresponding to the portion of the polymer protective layer where the key top is arranged.

16. A key sheet according to claim 14, wherein the polymer protective layer covers at least one surface of the graphite sheet.

17. A key sheet according to claim 16, wherein the polymer protective layer envelops and covers the graphite sheet as a whole.

18. A key sheet according to claim 14, wherein the polymer protective layer is a resin film.

19. A key sheet according to claim 14, wherein the polymer protective layer is a polymer coating film.

20. A key sheet according to claim 14, wherein the heat diffusion sheet has the through-hole extending in the thickness direction of the heat diffusion sheet and the float-supporting portion formed of a rubber-like elastic material filling the through-hole and elastically supporting the key top so that the key top is capable of being displaced through depression.

21. A key sheet according to claim 20, wherein the polymer protective layer covers at least one surface of the graphite sheet.

22. A key sheet according to claim 21, wherein the polymer protective layer envelops and covers the graphite sheet as a whole.

23. A key sheet according to claim 20, wherein the polymer protective layer is a resin film.

24. A key sheet according to claim 20, wherein:

the key top is formed of a translucent resin; and the float-supporting portion is formed of a translucent rubber-like elastic material.

25. A key sheet according to claim 20, wherein the polymer protective layer is a polymer coating film.

26. A key sheet according to claim 25, wherein:

the key top is formed of a translucent resin; and the float-supporting portion is formed of a translucent rubber-like elastic material.

27. A key sheet according to claim 1, wherein the heat diffusion sheet is composed of a graphite sheet and a thin metal plate, in which the graphite sheet is stacked to the key top side than the thin metal plate.

28. A key sheet according to claim 1, wherein the polymer protective layer is a light diffusion layer diffusing light from an illumination light source mounted on a board.

* * * * *